United States Patent [19]

Emura et al.

[11] Patent Number: 4,993,099

[45] Date of Patent: Feb. 19, 1991

[54] CLEANING AND POLISHING PAD

[75] Inventors: Akira Emura; Hisao Nishiyama, both of Tokyo, Japan

[73] Assignee: Yachiyo Micro Science Company Limited, Tokyo, Japan

[21] Appl. No.: 457,240

[22] Filed: Dec. 27, 1989

[51] Int. Cl.[5] ..... A47L 13/16

[52] U.S. Cl. ..... 15/118; 15/209 R; 428/285

[58] Field of Search ..... 15/118, 208, 209 R, 15/209 B, 209 C, 244.3; 428/246, 247, 251, 252, 284, 285

[56] References Cited

U.S. PATENT DOCUMENTS

| | | | |
|---|---|---|---|
| 3,144,671 | 8/1964 | Gould et al. | 15/208 |
| 4,144,612 | 3/1979 | Yamaguchi | 15/208 |
| 4,287,633 | 9/1981 | Gropper | 15/244.3 X |
| 4,493,866 | 1/1985 | Kim | 15/118 |
| 4,546,515 | 10/1985 | Clayton | 428/285 |
| 4,665,580 | 5/1987 | Morris | 15/118 |

FOREIGN PATENT DOCUMENTS

| | | | |
|---|---|---|---|
| 270933 | 5/1969 | Austria | 15/244.3 |
| 671298 | 10/1963 | Canada | 15/244.3 |
| 11063 | 1/1916 | United Kingdom | 15/244.3 |

*Primary Examiner*—Henry J. Recla
*Assistant Examiner*—Glenn T. Barrett
*Attorney, Agent, or Firm*—Merchant, Gould, Smith, Edell, Welter & Schmidt

[57] ABSTRACT

A pad for cleaning and polishing a wide variety of surfaces is disclosed. The pad includes two outer sheets made of filament material, an inner sheet made of elastic material and sandwiched between the two outer sheets, and two mesh sheets, wherein said inner sheet and said outer sheets are sandwiched between said mesh sheets. The filament material is rugged enough to effectively remove contamination that is firmly adhered to the surface to be cleaned, yet it is also fine enough to avoid damage to delicate surfaces and to be suitable for polishing purposes. Also, the elastic material is flexible enough to allow the filament material to be forced through the gaps in the mesh sheets and into contact with the surface to be cleaned and/or polished.

3 Claims, 1 Drawing Sheet

FIG. 1
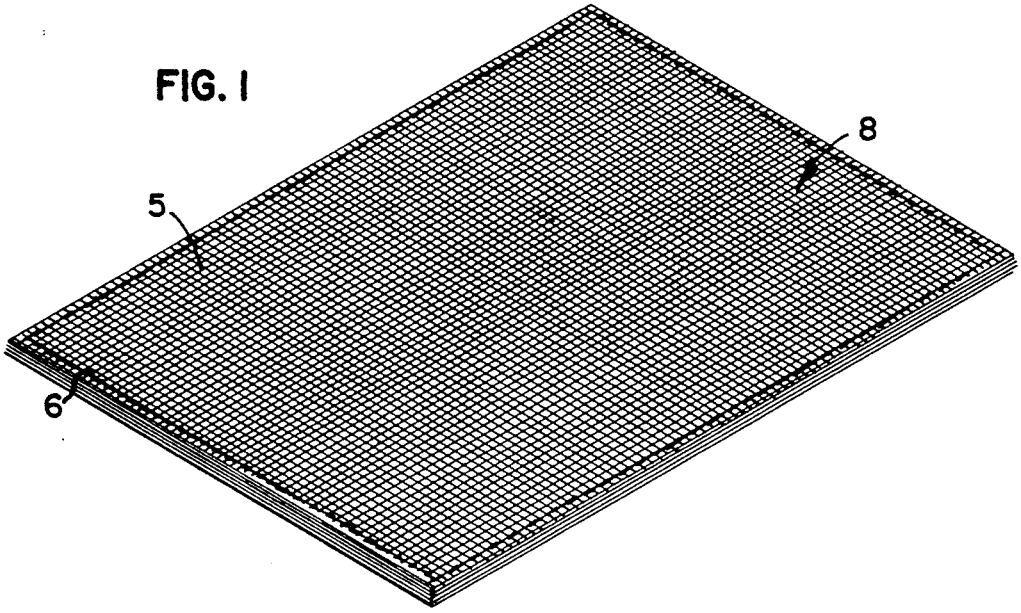
FIG. 2
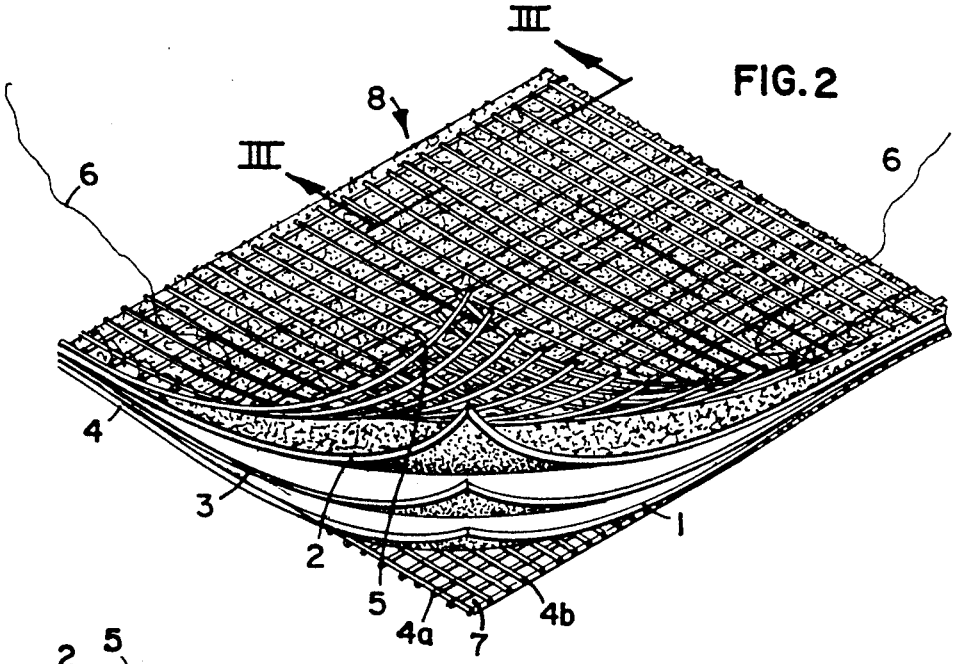
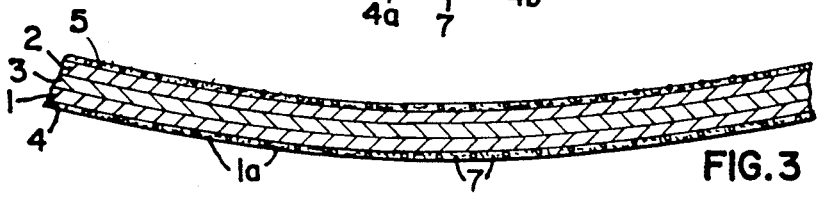
FIG. 3

CLEANING AND POLISHING PAD

BACKGROUND OF THE INVENTION

1. Field of the Invention

This invention relates to a pad for cleaning and polishing a wide variety of surfaces.

2. Description of the Art

Although there is a wide variety of devices available for cleaning and polishing purposes, each device seems to have certain shortcomings. For example, steel wool pads may damage plastic or painted surfaces and do not effectively clean areas of complicated unevenness due to their relative inelasticity. Another example is the nylon brush, which does not remove rugged contaminants without the aid of a cleanser or solvent. Additionally, cleansers and solvents, as well as steel wool, are sometimes undesirable because they are difficult to use and/or irritate the skin.

It is desirable to have a device for cleaning and polishing purposes that effectively cleans and polishes a wide range of surfaces, without the possibility of damaging those surfaces. Also it is desirable for such a device to effectively clean and polish surfaces having complicated unevenness. Finally, it is desirable that a device for cleaning and polishing purposes be safe and easy to use and not require any cleanser or solvent. While each of the prior art devices satisfies one or more of the desired design attributes for a cleaning and polishing device, none has provided a design which collectively satisfies all of the desired design attributes at the same time. The present invention addresses the problems of the prior art devices.

The present invention provides a pad for cleaning and polishing purposes. The filaments in the pad are rugged enough to remove stubborn contaminants yet fine enough that they will not damage a plastic or painted surface. Also, the pad is versatile enough to reach areas of complicated unevenness. Finally, the pad is safe and easy to use because no cleansers or solvents are required, and the relatively fine fibers do not irritate the skin.

SUMMARY OF THE INVENTION

The present invention provides a pad for cleaning and polishing purposes. The pad is used by rubbing it against the surface to be cleaned and/or polished. The rubbing may be done by hand or with the aid of a tool.

According to one aspect of the invention there is provided a pad for cleaning and polishing, comprising: (a) a first outer sheet of a first filament material; (b) a second outer sheet of a second filament material; (c) an inner sheet of elastic material that is sandwiched between said first outer sheet and said second outer sheet; and (d) two mesh sheets, wherein said inner sheet and said outer sheets are sandwiched between said mesh sheets.

According to a preferred embodiment of the invention, there is provided a pad for cleaning and polishing, comprising: (a) two outer sheets made of a very fine stainless steel filament with a diameter between 3 and 15 micrometers; (b) an inner sheet of elastic material that is sandwiched between said outer sheets, and wherein all of said sheets are sewn together; and (c) two mesh sheets of knitted mono-filament of synthetic fiber with a diameter between 1 and 15 millimeters, wherein said inner sheet and said outer sheets are sandwiched between said mesh sheets, and all of said sheets are sewn together.

BRIEF DESCRIPTION OF THE DRAWINGS

FIG. 1 is a perspective view of the pad;

FIG. 2 is a diagrammatic view of the pad; and

FIG. 3 is a cross-sectional view of the pad.

DESCRIPTION OF THE PREFERRED EMBODIMENT

Referring to the Figures, wherein like numerals represent like parts throughout the several views, FIG. 1, FIG. 2, and FIG. 3 show different views of a pad 8 for cleaning and polishing. An inner sheet 3 is sandwiched between a first outer sheet 1 and a second outer sheet 2, all of which is sandwiched between two mesh sheets 4 and 5. All of the sheets 1–5 are then sewn together around their perimeters by stitching 6. The inner sheet 3 is made of an elastic material, such as sponge rubber or thick synthetic fiber non-woven fabric, and in the preferred embodiment, soft synthetic resin foam. The outer sheets 1 and 2 are made of a fine filament that has been entangled and piled up to form a felt-like material. In the preferred embodiment, both outer sheets 1 and 2 are made of a very fine stainless steel filament having a diameter between 3 and 15 micrometers. However, the outer sheets may be made from a wide variety of filament materials and/or each outer sheet may be made of a different filament material. The possibilities include other metal filaments such as nickel, titanium, copper, and tungsten, inorganic filaments such as glass, carbon, ore slug, alumina, and silicon carbide, organic filament such as carbon and aramid filament, and organic filament surfaces that are covered with layers of grinding material and binder. The mesh sheets 4 and 5 are made of a knitted mono-filament of synthetic fiber having a diameter between 1 and several millimeters, and obvious alternatives are available.

The mesh sheets 4 and 5, in conjunction with the stitching 6, prevent the outer sheets 1 and 2 from separating from the inner sheet 3. The mesh sheet 4 consists of strands **4*a* and 4*b* that are arranged as shown in FIG. 2 to create gaps 7. Also, mesh sheet 5 is identical to mesh sheet 4, so that mesh sheet 5 also defines gaps. As shown in FIG. 3, the gaps 7 of mesh sheet 4 and the elasticity of the inner sheet 3 make it possible to force the filament material 1*a* of the outer sheet 1 beyond the mesh 4 and into contact with the surface to be cleaned and/or polished. Again, the same is true of the gaps of mesh sheet 5 and the corresponding filament material of the outer sheet 2**.

The stainless steel filament is fine enough for polishing purposes and for avoiding damage to delicate surfaces, such as paint and plastic, yet it is also rugged enough to effectively remove contamination that is firmly adhered to the surface to be cleaned. Moreover, the use of metallic filament material that is a conductor of electricity will eliminate the possibility of static buildup where the surface to be cleaned or polished would otherwise become charged and more readily attract dust. Also, the mesh sheets 4 and 5 help prevent twisting of the filament material at the surface and resulting balling of the filament material. Finally, obvious means are available for attaching the pad to a tool, such as a power drill, that facilitates movement of the pad across the surface to be cleaned and/or polished.

While a specific embodiment of the invention has been disclosed, it is to be understood that such disclosure has been merely for the purpose of illustration and that the invention is not to be limited in any manner thereby. Various modifications of this invention will be apparent to those skilled in the art in view of the foregoing example. The scope of the invention is to be limited only by the appended claims.

What is claimed is:

1. A pad for cleaning and polishing, comprising:

(a) a first outer sheet made of a very fine stainless steel filament with a diameter between 3 and 15 micrometers;

(b) a second outer sheet made of a very fine stainless steel filament with a diameter between 3 and 15 micrometers;

(c) an inner sheet of elastic material that is sandwiched between said first outer sheet and said second outer sheet; and (d) two mesh sheets, wherein said inner sheet and said outer sheets are sandwiched between said mesh sheets.

2. A pad according to claim 1, wherein said sheets are sewn together.

3. A pad according to claim 2, wherein said mesh sheets are made of a knitted mono-filament of synthetic fiber with a diameter between 1 and 15 millimeters.

* * * * *